US006831878B2

(12) United States Patent
Chen et al.

(10) Patent No.: US 6,831,878 B2
(45) Date of Patent: Dec. 14, 2004

(54) ELECTRONIC DEVICE CAPABLE OF COUNTING DOWN TO AN INTEGRAL TIME POINT

(75) Inventors: Frank Chen, Taipei Hsien (TW); Chuan Wang Chang, Taipei Hsien (TW)

(73) Assignee: Kinpo Electronics, Inc., Taipei Hsien (TW)

( * ) Notice: Subject to any disclaimer, the term of this patent is extended or adjusted under 35 U.S.C. 154(b) by 321 days.

(21) Appl. No.: 09/956,887

(22) Filed: Sep. 21, 2001

(65) Prior Publication Data

US 2003/0058743 A1 Mar. 27, 2003

(51) Int. Cl.[7] ..... G04F 5/00
(52) U.S. Cl. ..... 368/108; 368/109
(58) Field of Search ..... 368/89, 107–111

(56) References Cited

U.S. PATENT DOCUMENTS 4,005,571 A * 2/1977 Wolff ..... 368/108
4,195,220 A * 3/1980 Bristol et al. ..... 368/96
4,385,841 A * 5/1983 Kramer ..... 368/111
4,448,544 A * 5/1984 Schreitz ..... 368/239
4,451,896 A * 5/1984 Pomerleau et al. ..... 368/10
4,671,673 A * 6/1987 Terzian ..... 368/82
5,805,534 A * 9/1998 Terzian ..... 368/241
6,104,674 A * 8/2000 Emoff et al. ..... 368/109
6,493,290 B1 * 12/2002 Terzian ..... 368/82
6,584,041 B1 * 6/2003 Terzian et al. ..... 368/82

* cited by examiner

*Primary Examiner*—Kamand Cuneo
*Assistant Examiner*—Jeanne-Marguerite Goodwin
(74) *Attorney, Agent, or Firm*—Bacon & Thomas, PLLC

(57) ABSTRACT

An electronic device capable of counting down to an integral time point has an integral time point selector for setting an integral time point. A timer serves for recording the current time. A synchronous calculating unit serves for reading the integral time point from the integral time point selector and reading the current time from the timer. The time interval from the current time to the integral time point is calculated as a counting down time period. A counter serves for reading the counting down time interval from the synchronous calculating unit and starting to count down.

7 Claims, 3 Drawing Sheets

ELECTRONIC DEVICE CAPABLE OF COUNTING DOWN TO AN INTEGRAL TIME POINT

BACKGROUND OF THE INVENTION

1. Field of the Invention

The present invention relates to an electronic device, and particularly to an electronic device capable of counting down to an integral time point.

2. Description of Related Art

Since a countdown timer benefits human life by notifying people of an important event, it has been widely used in human life and has wide applications, such as in a watch, a clock. The electronic device as claimed in claim 1, wherein consumer electronics, uninterruptible power systems, etc. for indicating the setting time to people or a preset time for executing an operation. However, during use of the known countdown timer, the user must set the time to be counted down, while the setting process will consume some time so that the time period elapsed will result in that the set time is not synchronous with the current time. If the user desires to adjust this error, it costs additional time, and further it is very difficult to cancel the error completely. For example, in some applications, a specific apparatus must be activated or an operation must be executed at an integral time point, such as the hour, the half hour, or the quarter hour. Therefore, the user must take some time to set the time period to be counted down, while, as the setting is completed, the actual time to be counted down is shorter than the set time. Therefore, the conventional countdown timer cannot meet the actual requirement. Therefore, it is desirable to provide an improved electronic device to mitigate and/or obviate the aforementioned problems.

SUMMARY OF THE INVENTION

The object of the present invention is to provide an electronic device capable of counting down to an integral time point, whereby the user may count down to an integral time point rapidly and synchronously with the current time.

To achieve the object, the electronic device of the present invention comprises: an input unit for operating the electronic device; an integral time point selector for setting an integral time point at which the counting down period is to end (such as the next hour, next half hour, or next quarter hour); a timer for recording a current time; a synchronous calculating unit for reading the integral time point from the integral time point selector and reading the current time from the timer to determine the time interval from the current time to the next integral time point for use as a counting down time period from the synchronous calculating unit.

The various objects and advantages of the present invention will be more readily understood from the following detailed description when read in conjunction with the appended drawing.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
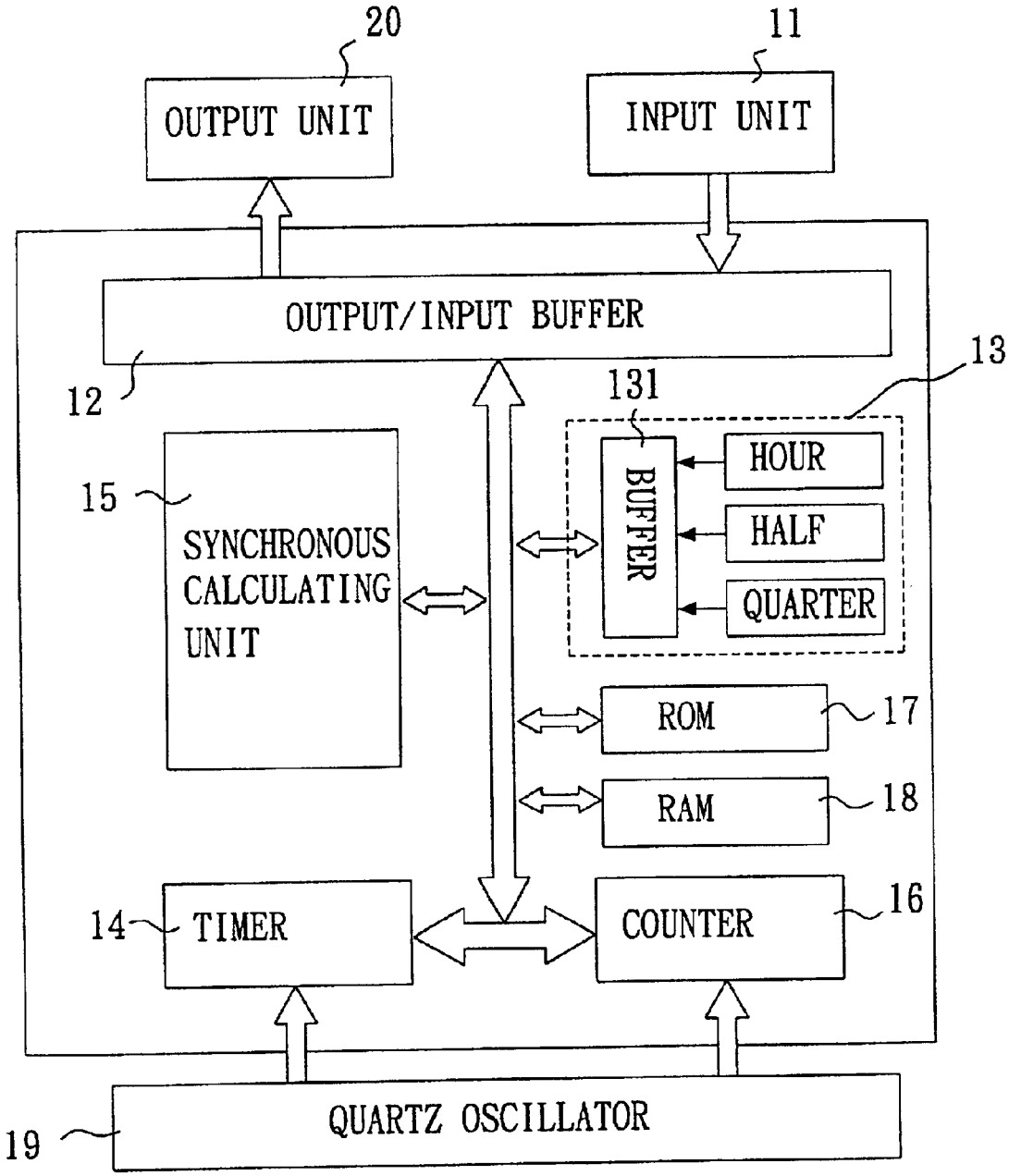
FIG. 1 is a functional block diagram of the electronic device capable of counting down to an integral time point in accordance with the present invention.

Referring to FIG. 1, there is illustrated a functional block diagram for one preferred embodiment of the electronic device capable of counting down to an integral time point in accordance with the present invention. The electronic device of the present invention includes an input unit 11, an output/input buffer device 12, an integral time point selector 13, a timer 14, a synchronous calculating unit 15, a counter 16, a read only memory (ROM) 17, a random access memory (RAM) 18, a quartz oscillator 19, an output unit 20, etc. the read only memory 17 serves for storing program code for controlling, for example, a counting down operation. The random access memory 18 provides a memory space for executing a program.

The input unit 11 is, for example, a keypad or a touch panel for operating the electronic device. The output unit 20 is an LCD display panel for displaying the current time, the remaining time in performing a counting down operation, and the status of the electronic device. The output/input buffer device 12 buffers the data to be input or output. The timer 14 serves for counting and sustaining the current time. The counter 16 serves to count down a time period to be counted down. The quartz oscillator 19 provides a basic synchronous clock to the timer 14 and the counter 16. The integral time point selector 13 serves for selecting an integral time point or setting an integral time point for being used as an ending time of the counting down operation. The synchronous calculating unit 15 serves to provide a counting down time period based on the integral time point and the current time.

Figure 2A:
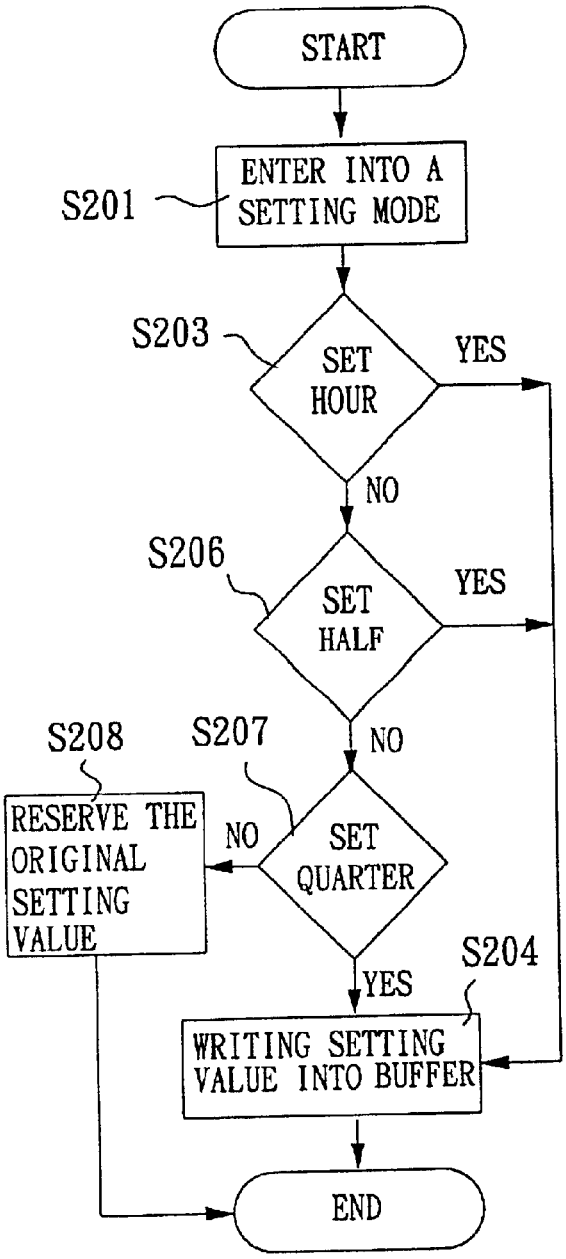
FIG. 2A shows the flow diagram to set the integral time point for counting down in accordance with the present invention.

When the above electronic device performs a counting down operation for counting down to an integral time point. An integral time point provided as the ending time of the counting down operation can be set at first. Referring to FIG. 2A, a flow diagram to set the integral time point for counting down in accordance with the present invention is illustrated. At first, the user operates the input unit 11 for starting a setting mode by pressing a button (step S201). In this mode, at first, it is determined whether the integral time point selector 13 is set in an integral hour (step S203). If yes, the set value is stored in the buffer 131 (step S204), and the setting mode is over. Otherwise, it is determined whether the integral time point selector 13 is set in an integral half hour (step S206). Similarly, if yes, the setting value is stored to the buffer 131 (step S204). Then, the setting mode is over. Otherwise, it is further determined whether the integral time point selector 13 is set in an integral quarter time. Again, if yes, the setting value is stored to the buffer 131 (step S204). Then, the setting mode is over. Otherwise, the previous setting value is reserved in the buffer 131 (step S208), and the setting mode is over.

In this preferred embodiment, it is assumed that the integral time point selector 13 provides the integral hour, the integral half hour, and the integral quarter for being selected.

However, in practical application, some other integral time points, such as five-minute or ten-minute, can be provided. Alternatively, such integral time points can be directly inputted to the buffer 131 by the user.

Figure 2B:
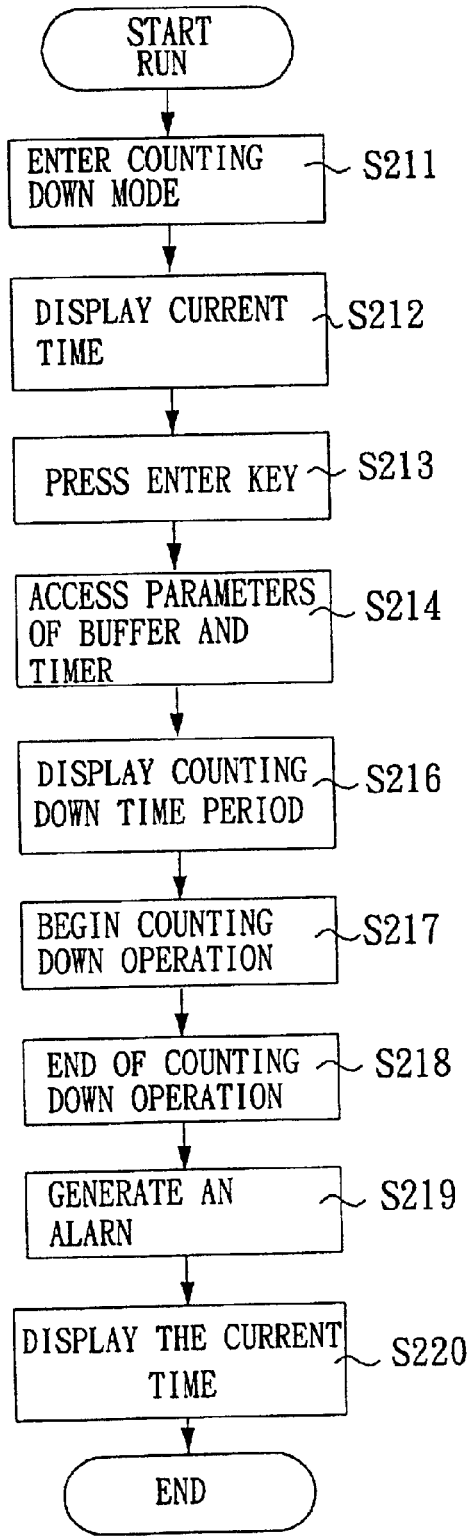
FIG. 2B shows the flow diagram of the electronic device capable of counting down to an integral time point in accordance with the present invention.
Figure 3A:
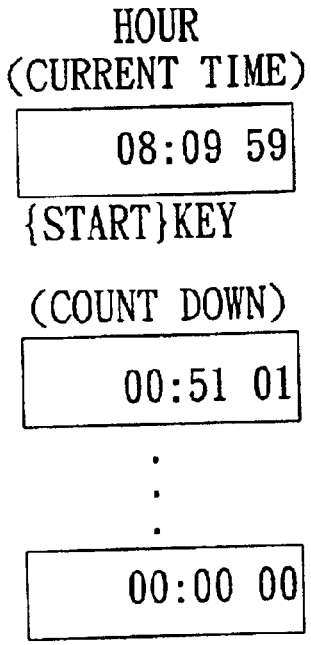
FIGS. 3A~3C schematically illustrating the output screens of the electronic device capable of counting down to an integral time point in accordance with the present invention.
Figure 3B:
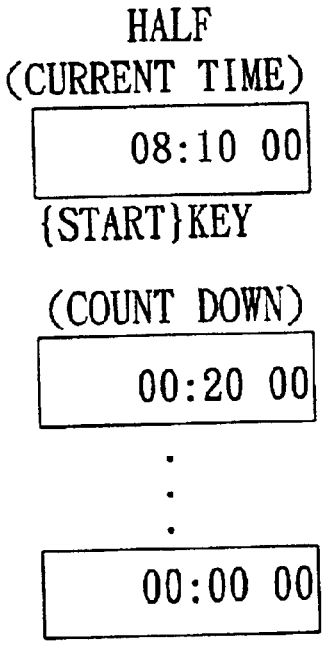
Figure 3C:
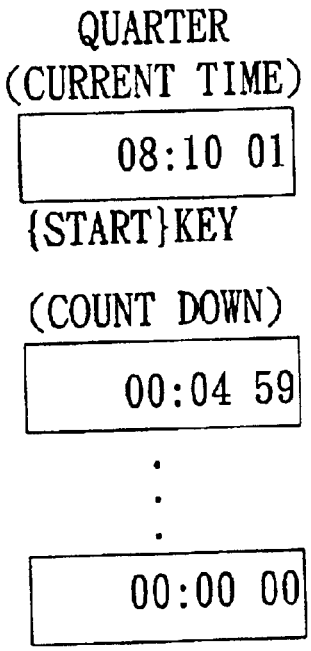

When the setting mode is completed, the user may start to count down without setting further. Referring to FIG. 2B, the button in the input unit 11 can be pressed to enter into the counting down mode (step S211). Then, the timer 14 sends the current time to the output unit 20 for display (step S212). The user further presses the enter key of the input unit 11 (step S213) for starting the counting down process. Then, the synchronous calculating unit 15 reads the setting value from the buffer 131 and the current time from the timer 14 (step S214). Then, based the setting value and the current time, the counting down time period is determined as the time interval from the current time to the setting value, and this counting down time period is displayed on the output unit 20 (step S216). Next, the counting down time period is transferred to the counter 16 for counting down (step S217). For example, as shown in FIGS. 3A to 3C, the electronic device of the present invention is set at an integral hour, an integral half hour and an integral quarter hour for counting down, respectively. When reaching the end of the counting down process (step S218), the counter 16 transfers an end message to the output unit (step S219). For example, the end message may be an alarm voice from an electronic buzzer and/or flashing light on a display panel. When the counting down process is ended, the display panel of the output unit 20 returns to the original condition, and the current time is displayed (step S220).

In view of the foregoing, it is known that the electronic device of the present invention is able to not only perform a counting down process to an integral time point, but also count down synchronously with the current time. Therefore, the time of counting down is related with the current time and no setting time is required in counting down, thereby achieving a maximum efficiency in performing the counting down process.

Although the present invention has been explained in relation to its preferred embodiment, it is to be understood that many other possible modifications and variations can be made without departing from the spirit and scope of the invention as hereinafter claimed.

What is claimed is:

1. An electronic device capable of counting down to a next integral time point, comprising:

an input unit for operating the electronic device;

an integral time point selector with an hour, a half-hour, and a quarter-hour countdown time points for setting the next integral time point with respect to a current time, wherein selection of one of the hour, half-hour, and quarter-hour countdown time points of the selector causes the electronic device to count down to the next hour, half-hour, or quarter-hour depending on which of the countdown time points is selected;

a timer for recording the current time;

a synchronous calculating unit for reading the integral time point from the integral time point selector and reading the current time from the timer to determine the time interval from the current time to the next integral time point for use as the counting down time period; and a counter for performing a counting down operation based on the counting down time period from the synchronous calculating unit; and an output unit for displaying the current time of the electronic device and said integral time from the current time to the next integral time point and for indicating an end of counting down.

2. The electronic device as claimed in claim 1, wherein the integral time point is settable in the integral time point selector.

3. The electronic device as claimed in claim 1, wherein the counter reads the counting down time period from the synchronous calculating unit to start to count down and generate a message for notifying the user at the end of counting.

4. The electronic device as claimed in claim 3, wherein the message is a voice from an electronic buzzer.

5. The electronic device as claimed in claim 3, wherein the message is a flashing light.

6. The electronic device as claimed in claim 1, further comprising a quartz oscillator for providing a basic synchronous clock signal to the timer and the counter.

7. The electronic device as claimed in claim 1, wherein the integral time point selector includes a buffer connected to the countdown time points for buffering the set integral time points, which are used to set at least an hour countdown, a half hour countdown, and an quarter hour countdown.

* * * * *